US005839208A

United States Patent [19]

Huang

[11] Patent Number: 5,839,208

[45] Date of Patent: Nov. 24, 1998

[54] RESILIENT SOLE FOR SHOE

[75] Inventor: Chin-Shui Huang, Taipei, Taiwan

[73] Assignees: Ho-Tai Industrial Co., Taipei, Taiwan; Hoard International Corp., Wilmington, Del.

[21] Appl. No.: 844,330

[22] Filed: Apr. 18, 1997

[51] Int. Cl.[6] ..... A43B 13/18; A43B 13/20

[52] U.S. Cl. ..... 36/28; 36/30 R; 36/29

[58] Field of Search ..... 36/28, 29, 3 B, 36/141, 30 R

[56] References Cited

U.S. PATENT DOCUMENTS

| | | | |
|---|---|---|---|
| 3,834,046 | 9/1974 | Fowler | 36/28 |
| 4,910,882 | 3/1990 | Goller | 36/3 B |

FOREIGN PATENT DOCUMENTS

| | | | |
|---|---|---|---|
| 1164720 | 10/1958 | France | 36/29 |
| 495067 | 4/1930 | Germany | 36/3 B |
| 2150010 | 6/1985 | United Kingdom | 36/29 |
| 2152797 | 8/1985 | United Kingdom | 36/28 |

*Primary Examiner*—Ted Kavanaugh
*Attorney, Agent, or Firm*—Rosenberg, Klein & Bilker

[57] ABSTRACT

A resilient sole for shoes includes a soft top layer, a bottom layer, and a resilient intermediate layer sandwiched between the soft top layer and the bottom layer. The intermediate layer has a plurality of curved strips parallel to each other and disposed transversely to a longitudinal axis of the intermediate layer. The curved strips are sloped upwardly toward the toe part of the sole, and are forced to deform and to absorb vibrations when the sole is pressed against the ground by the foot of a wearer.

8 Claims, 7 Drawing Sheets

RESILIENT SOLE FOR SHOE

BACKGROUND OF THE INVENTION

The present invention relates to a resilient sole for shoes, and more particularly to such a resilient sole which effectively absorbs shocks and buffers the impact when the foot walks.

The sole of a regular shoe, as shown in FIG. 1, comprises a top layer 1 (under the vamp 4) adapted to be disposed in contact with the sole of the foot, a bottom layer 3 adapted to be disposed in contact with the ground, and a longitudinally and transversely ribbed intermediate layer 2 sandwiched in between the top layer 1 and the bottom layer 3. Because the intermediate layer 2 is reinforced with intersected ribs, it cannot be quickly deformed to eliminate shocks and then returned to its former shape immediately after the pressure is disappeared. In order to effectively absorb shocks when walking, air cushion and like means may be installed in the sole of a shoe. However, the installation of these shock absorbing means greatly increases the manufacturing cost of the shoe.

SUMMARY OF THE INVENTION

The present invention has been accomplished to provide a resilient sole which eliminates the aforesaid problems. It is one object of the present invention to provide a resilient sole which can effectively absorb shocks and buffer the impact. It is another object of the present invention to provide a resilient sole which is inexpensive to manufacture. According to one embodiment of the present invention, the resilient sole comprises a soft top layer, a bottom layer, and a resilient intermediate layer sandwiched in between the top layer and the bottom layer, the intermediate layer having a plurality of curved strips transversely disposed in parallel and sloping upwardly forwards, the curved strips being forced to deform and to absorb vibrations when the sole is pressed against the ground by the foot. As an alternate form of the present invention, intersected ribs may be form on the intermediate layer at its rear half part.

DETAILED DESCRIPTION OF THE PREFERRED EMBODIMENT

Figure 1:
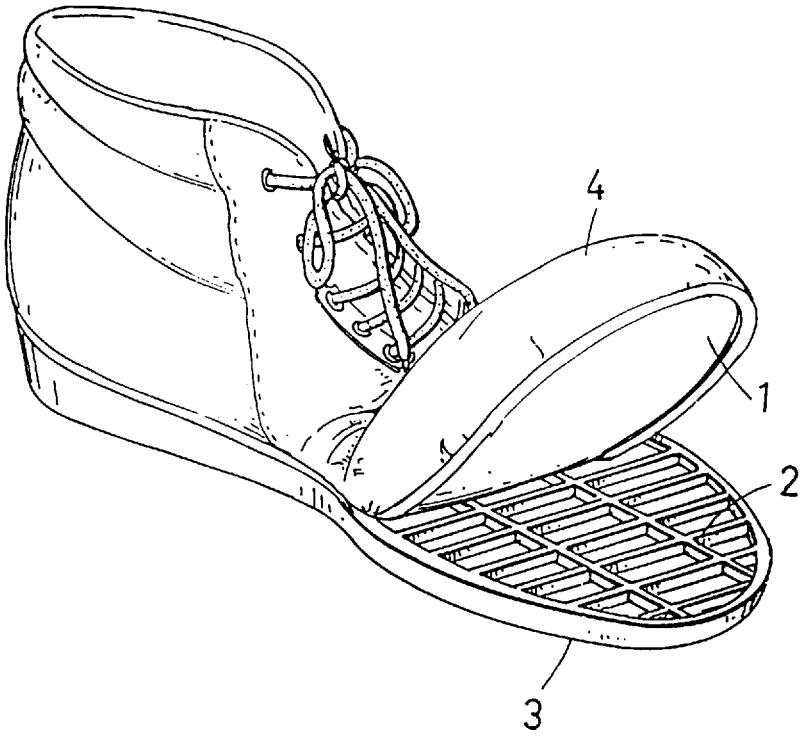
FIG. 1 shows the structure of the intermediate layer of the sole of a conventional shoe.
Figure 2:
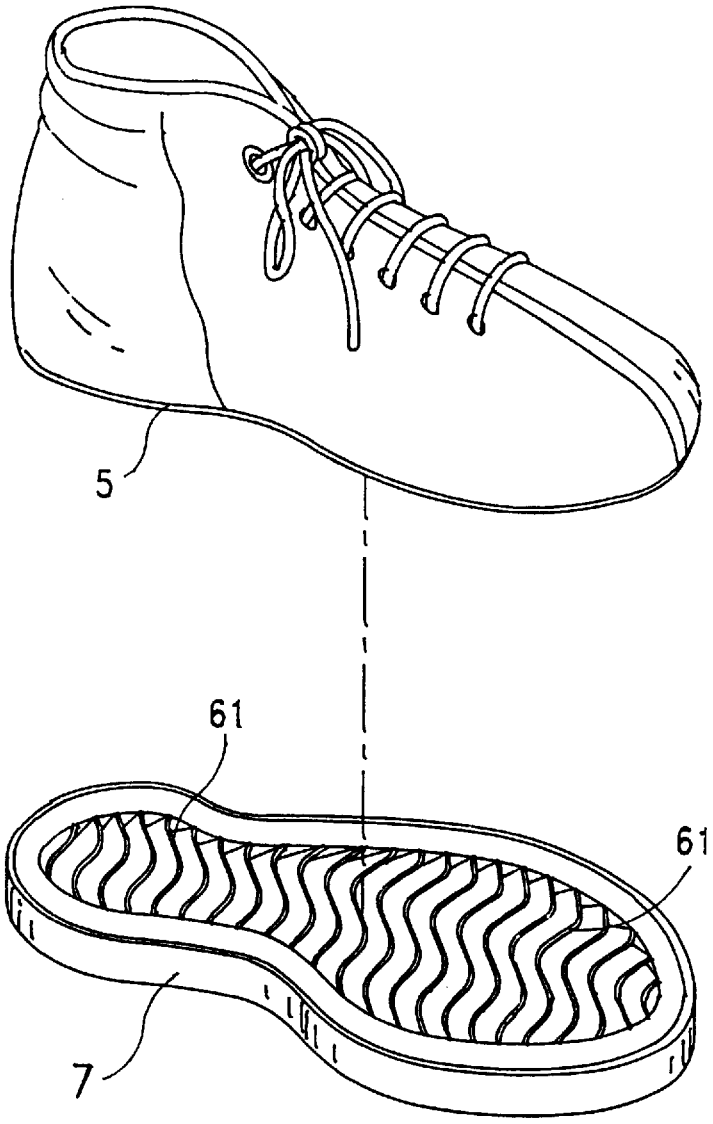
FIG. 2 is an exploded view of an embodiment of the present invention, showing the structure of the intermediate layer.
Figure 3:
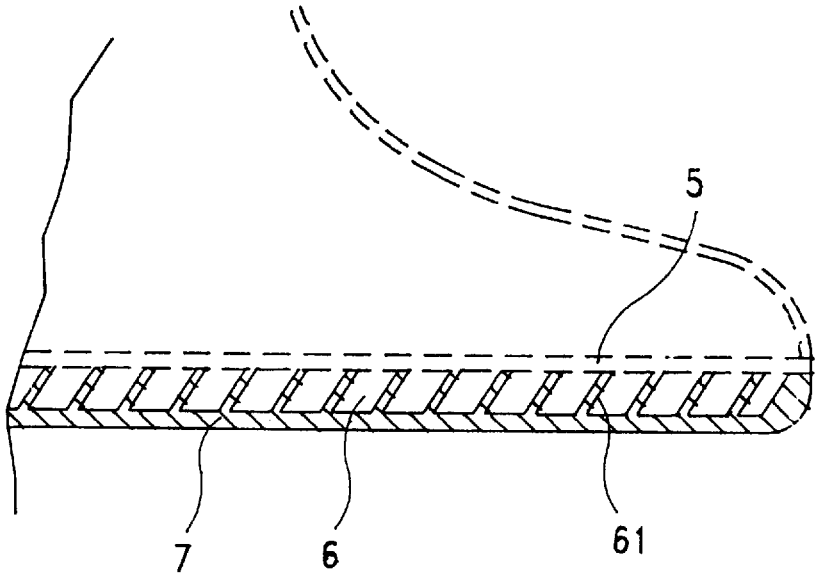
FIG. 3 is a side plain view of the embodiment of FIG. 2.

Referring to FIGS. 2 and 3, a resilient sole in accordance with the present invention comprises essentially a soft top layer 5 fastened to the vamp and adapted to be disposed in contact with the sole of the foot, a bottom layer 7 fastened to the top layer 5 at the bottom and adapted to be disposed in contact with the ground, and a resilient intermediate layer 6 sandwiched in between the top layer 5 and the bottom layer 7. The resilient intermediate layer 6 is comprised of a plurality of curved strips 61 transversely disposed in parallel and sloping upwardly forwards (toward the box toe of the vamp) at an angle. The density and thickness of the curved strips 61 are sufficient to support the pressure of the user.

Figure 4:
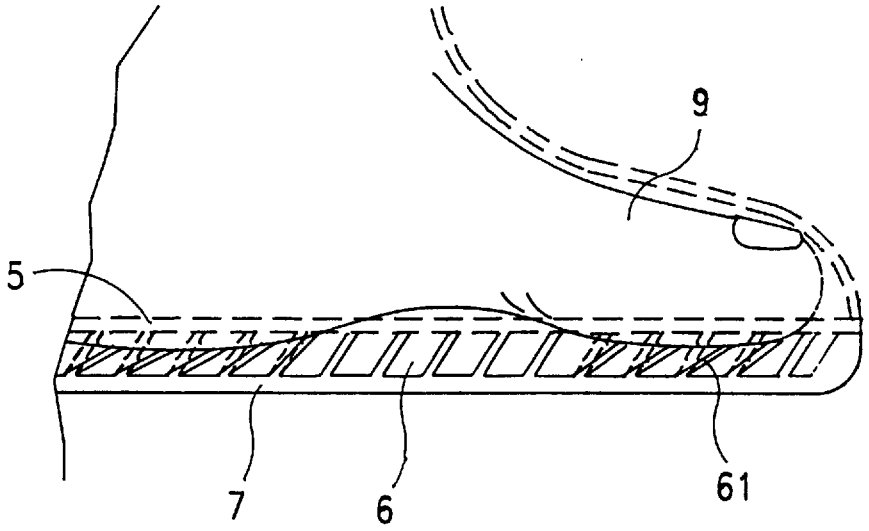
FIG. 4 is similar to FIG. 3 but showing the foot pressed on the sole, the curved strips of the intermediate layer deformed.

Referring to FIG. 4, when the foot 9 is pressed on the resilient sole against the ground, the curved strips 61 are forced to deform and tilted forwardly downwards to absorb vibrations and to buffer the impact. When the foot 9 is lifted from the ground, the curved strips 61 are released, and forced by their resilient material property to return to their former shape (see FIG. 3).

Figure 5:
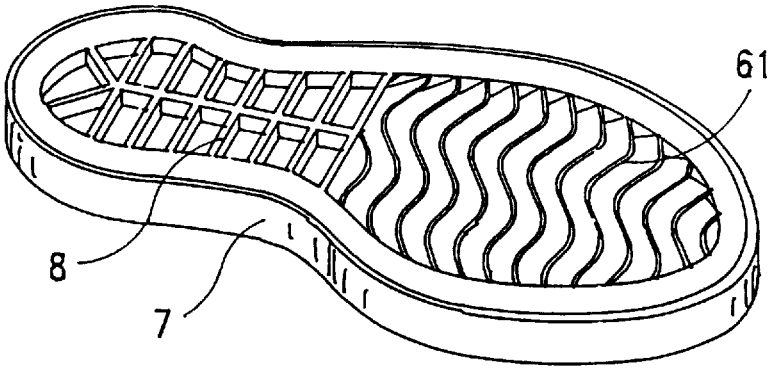
FIG. 5 shows an alternate form of the intermediate layer according to the present invention.

FIG. 5 shows an alternate form of the present invention, in which the front half of the intermediate layer is comprised of a plurality of curved strips 61 transversely disposed in parallel and sloping upwardly forwards (toward the box toe of the vamp), and the rear half of the intermediate layer is comprised of intersected ribs 8.

Figure 6:
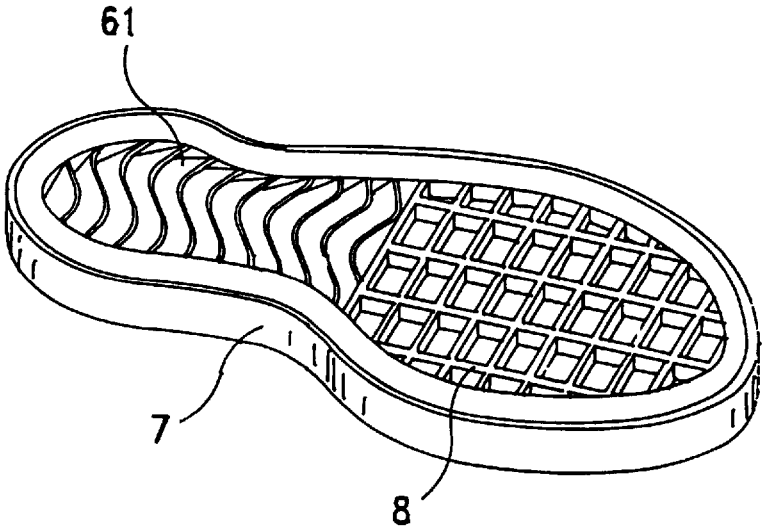
FIG. 6 shows another form of the present invention in which the structure of the front half and the rear half of the intermediate layer are interchanged from the form shown in FIG. 5.

According to another embodiment of the present invention, shown in FIG. 6, the resilient intermediate layer 6 includes a plurality of curved strips 61 extending in parallel each to the other and transversely to a longitudinal axis of the sole, which are disposed within the area of a rear half thereof, and a plurality of intersecting ribs 8 are disposed within the area of a front half of the resilient intermediate layer 6. Similar to other embodiments of the present invention, the curved strips 61 are sloped upwardly toward the toe of the shoe.

Figure 7:
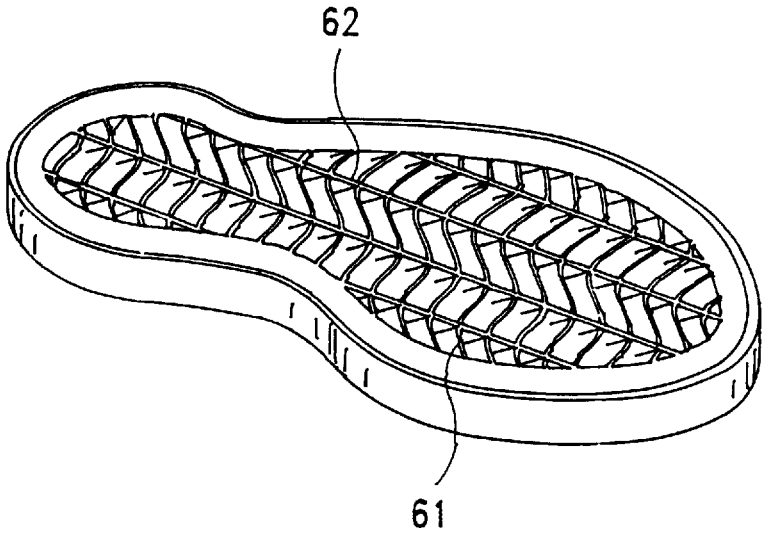
FIG. 7 shows still another alternate form of the intermediate layer according to the present invention.

FIG. 7 shows another alternate form of the present invention in which the intermediate layer is comprised of a plurality of curved strips 61 transversely disposed in parallel and sloping upwardly forwards (toward the box toe of the vamp), and a plurality of longitudinal ribs 62 intersecting the curved strips 61.

It is to be understood that the drawings are designed for purposes of illustration only, and are not intended as a definition or scope of the invention disclosed.

What the invention claimed is:

1. A resilient sole for a shoe, comprising:

a bottom layer, a top layer, a resilient intermediate layer sandwiched between said bottom layer and said top layer, said resilient intermediate layer having a front half area and a rear half area, a plurality of spaced apart curved strips disposed at either one of said front half and rear half areas, said curved strips extending substantially in parallel arrangement thereof and transversely to a longitudinal direction of said sole, each of said curved strips having a parallelogram shape in cross-section thereof and being inclined a predetermined acute angle with respect to said bottom layer, and a plurality of intersecting ribs in lattice arrangement thereof disposed at another one of said front half and rear half areas of said resilient intermediate layer.

2. The resilient sole of claim 1, wherein said curved strips are disposed at said front half area, and said intersecting ribs are disposed at said rear half areas.

3. The resilient sole of claim 2, wherein said curved strips are disposed at said rear half area, and said intersecting ribs are disposed of said front half area.

4. A resilient sole for a shoe, comprising:

a bottom layer;

a top layer, a resilient intermediate layer sandwiched between said bottom layer and said top layer, a plurality of spaced apart curved strips extending substantially in parallel arrangement thereof and transversely to a longitudinal direction of said sole, each of said curved strips having a parallelogram shape in cross-section thereof and being inclined a predetermined acute angle with respect to said bottom layer, and a plurality of spaced apart substantially parallel ribs extending along said longitudinal direction of said sole and intersecting said curved strips.

5. A resilient sole for shoes, essentially comprising:

a top layer provided to be in contact with paw of user;

a bottom layer provided to be in contact with ground; and an intermediate layer sandwiched between said top layer and said bottom layer, the front half-portion thereof comprising a plurality of wavelike transverse strips arranged in parallel to each other with a suitable distance therebetween, said strip being inclined forward with a suitable angle, the rear half-portion thereof comprising a plurality of ribs in latticed arrangement.

6. The resilient sole of claim 5, wherein said intermediate layer is further provided with a longitudinal rib crossed with said transverse strip.

7. A resilient sole for shoes, essentially comprising:

a top layer provided to be in contact with paw of user;

a bottom layer provided to be in contact with ground; and an intermediate layer sandwiched between said top layer and said bottom layer, the front half-portion thereof comprising a plurality of ribs in latticed arrangement, the rear half-portion thereof comprising a plurality of wavelike transverse strips arranged in parallel to each other with a suitable distance therebetween, said strip being inclined forward with a suitable angle.

8. The resilient sole of claim 7, wherein said intermediate layer is further provided with a longitudinal rib crossed with said transverse strip.

* * * * *